United States Patent [19]

Okutsu

[11] 4,346,657

[45] Aug. 31, 1982

[54] DUPLICATION PRINTER

[75] Inventor: Hiroyasu Okutsu, Zama, Japan

[73] Assignee: Pilot Man-Nen-Hitsu Kabushiki Kaisha, Tokyo, Japan

[21] Appl. No.: 158,712

[22] Filed: Jun. 12, 1980

[30] Foreign Application Priority Data

Jun. 18, 1979 [JP] Japan ..... 54-83960[U]

[51] Int. Cl.[3] ..... B41F 3/04

[52] U.S. Cl. ..... 101/269; 101/45; 434/410

[58] Field of Search ..... 101/269, 45; 434/410

[56] References Cited

U.S. PATENT DOCUMENTS

| | | | |
|---|---|---|---|
| 2,747,505 | 5/1956 | Bailey | 101/269X |
| 3,090,303 | 5/1963 | Manners et al. | 101/269 |
| 3,274,931 | 9/1966 | Pallorson | 101/269 |
| 3,279,100 | 10/1966 | Knott | 434/410 |
| 3,279,368 | 10/1966 | Wilson | 101/269 |
| 3,704,668 | 12/1972 | St. Onge et al. | 101/269 |
| 3,763,777 | 10/1973 | Brown | 101/269 |
| 3,830,155 | 8/1974 | Pinedo | 101/269 |

FOREIGN PATENT DOCUMENTS 53-14245 4/1978 Japan .

*Primary Examiner*—Edward M. Coven

*Attorney, Agent, or Firm*—Wenderoth, Lind & Ponack

[57] ABSTRACT

A duplication printer has a movable base slidably accommodated in a frame case and provided with a cushioning layer on which a relief plate bearing a relief pattern on top is placed, and then, on the relief plate, are stacked successively from bottom to top a paper sheet, a transfer sheet having a lower surface of an ink layer facing the paper sheet, a tacky sheet with a tacky layer on its upper surface, and a display sheet having light transmitting characteristic. The movable base is positioned within the frame case and is drawn outwardly from the frame case, a pressure bar passes relatively over the stack of sheets, whereupon the relief pattern is printed via the ink layer on the paper sheet and, simultaneously, the image of the pattern is displayed on the display sheet. Thus, the pattern on the display sheet can be observed by an operator without removing the paper sheet from the printer.

8 Claims, 21 Drawing Figures

DUPLICATION PRINTER

BACKGROUND OF THE INVENTION

This invention relates generally to duplicating and printing devices and more particularly to a novel duplicating and printing device (hereinafter referred to as a duplication printer) by which a pictorial pattern such as characters, diagrams, designs, and graphical figures can be reproduced from a relief plate and printed on a sheet material such as paper or a card and, simultaneously, be accurately displayed so that the reproduction can be observed by a printer operator.

Heretofore, printers, in which a pattern such as characters or a diagram are provided on a relief printing plate, print on a sheet of paper by laying the paper on the relief plate, placing thereon a sheet of carbon paper with its ink layer on the lower side, and applying pressure onto the carbon paper with means such as a roller. However in this printer, although a pattern which is the same as that of the relief plate can be printed on the paper, the printed pattern cannot be examined immediately after the printing. Consequently, verification of the accuracy of the duplication of the pattern and the quality of the printing finish is possible only after the printed paper has been taken out of the printer.

Furthermore with this known printer, when the pressure means such as a roller is moved over the carbon paper, the paper to be printed and the carbon easily shift as the pressing means travels in one direction and returns in the reverse direction, whereby the pattern of the relief plate is often printed on the paper in an overlapping and staggered manner.

SUMMARY OF THE INVENTION

This invention seeks to provide a duplication printer having novel features which overcome the above described problems encountered in the prior art printers, and the printer according to the present invention has additional novel features.

It is an object of the present invention to provide a duplication printer having a compact and easily operable size and simple construction and operation by which duplication printing can be carried out conveniently and quickly by manual actuation.

Another object of the invention is to provide a duplication printer in which a pattern on a relief plate can be duplication printed on a paper sheet and, moreover, can be simultaneously displayed with high fidelity on an outer sheet so that it can be examined by an operator, the displayed pattern being easily erasable by a simple method.

Still another object of the invention is to provide a duplication printer in which, in the manual operation of the printer, actuation of a movable base in a forward direction applies pressure to carry out the printing, and by a subsequent actuation in the reverse or return direction the pressure is removed, whereby double printing on the same sheet is avoided, whereby a distinct and accurate duplication printing is accomplished.

A further object of the invention is to provide a printer capable of carrying out simultaneous duplication on a plurality of sheets.

An additional object of the invention is to provide a duplication printer by which duplication printing can be carried out conveniently by the use of a transfer sheet or a transfer tacky sheet without the operator's hands being soiled by the ink of the transfer sheet.

According to this invention, there is provided a duplication printer comprising: a movable base provided on an upper surface or side thereof with a cushion material, and a holding frame having a window opening and positioned above the cushion material; a relief plate bearing a relief pattern and placed on the cushion material for duplicating the pattern thereof; a pattern duplicating and displaying unit including a paper sheet on which the pattern is to be printed and a display sheet on which the pattern is to be displayed, said unit being placed on the relief plate and held and in place thereagainst by the holding frame; and a frame case adapted to accommodate the movable base in a manner permitting the movable base to be drawn outwardly from and pushed toward and into the frame case and having a pressure bar swingably supported by swing links which have stops, the swing links striking against and being stopped by the stops when the movable base is drawn outwardly from the frame case, whereby the pressure bar applies pressure to the duplicating and displaying unit thereby printing the pattern on the paper sheet and displaying the same on the display sheet, and the swing links being movable away from the stops when the movable base is pushed toward and into the frame case, whereby the pressure bar ceases to apply pressure to said unit.

A feature of this invention is that, in the duplication printer, a relief pattern plate and a pattern duplicating and displaying unit are used in combination. At the time of printing, a relief plate having a relief pattern to be duplication printed is placed against the cushioning material with the relief pattern facing upwardly. Then, on the relief plate a pattern duplicating and displaying unit is positioned and is held down and thus fixed in position by a holding frame. The movable base is then drawn outwardly from the frame case to carry out the duplication printing.

The pattern duplicating and displaying unit according to this invention is novel. By its use, the pattern of the relief plate is printed on a paper sheet in this unit and, simultaneously, is displayed on an upper most sheet of a material having a light transmitting characteristic or being translucent (herein referred to as a translucent-/opaque sheet for a reason which will hereinafter become apparent or display sheet), which allows examination of the pattern on the display sheet by the operator. The displaying of the pattern in this manner on the display sheet is due to the adhesion of a tacky sheet, in accordance with the pattern of the relief plate, to the display sheet. At the points of contact of the pattern with the display sheet, the translucent/opaque display sheet becomes semitransparent at the points of contact of the relief plate with the display sheet, and these parts stand out as dark parts on the display sheet. The pattern thus displayed on the display sheet can be easily erased by manually separating the tacky sheet and the display sheet.

The pattern duplicating and displaying unit may comprise a great variety of materials and combinations of materials as will be described hereinafter.

A second feature of the invention is the printing action achieved by the combination of the cushioning material on the movable base, the pressure bar and the swinging support mechanism thereof, and the stops for limiting the swinging of the pressure bar in one direction. This combination functions to cause the pressure applied by the pressure bar to be positive and uniform when the movable base is pulled outwardly from the frame case. During this outward pulling, the relief plate is firmly pressed against the cushioning material so that the plate is prevented from moving relative to the base, thus ensuring a nonstaggered and clear printing of the pattern. Furthermore, when the movable base is pushed inwardly and back into the frame case, the pressing bar is swung away from the unit and therefore no longer applies pressure thereto, whereby a clearly distinct duplication printing can be carried out without there being any double impressions.

The nature, utility, and further features of the present invention will become clearly apparent from the following detailed description taken in conjunction with a description of the preferred embodiments of the present invention as illustrated in the accompanying drawings.

DETAILED DESCRIPTION OF THE INVENTION

Figure 1:
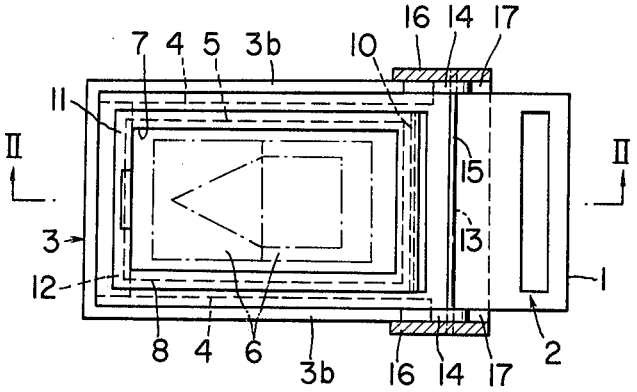
FIG. 1 is a plan view, partly in section, of a first embodiment of a printer according to the present invention.
Figure 2:
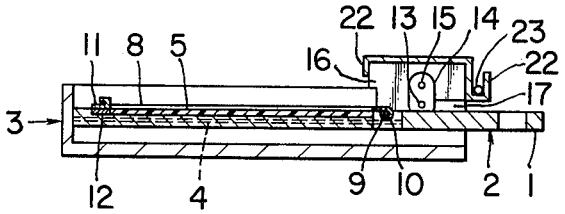
FIG. 2 is a vertical sectional view taken along the line II—II in FIG. 1.
Figure 3:
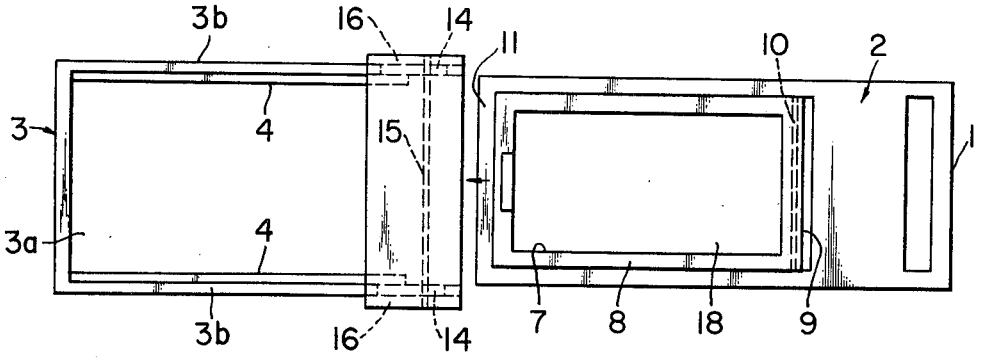
FIG. 3 is an exploded plan view showing the printer of FIG. 1 with its movable base drawn out of the frame case.
Figure 4:
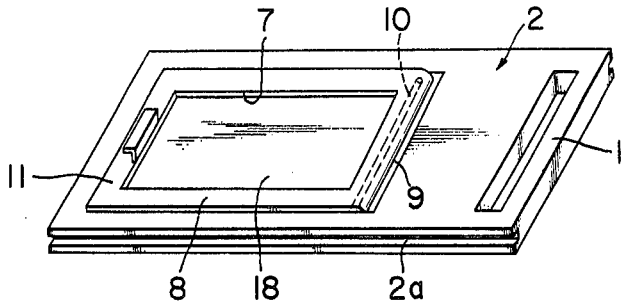
FIG. 4 is a perspective view of the movable base of the printer of FIG. 1 showing the holding frame in the closed state.

In the first embodiment of this invention illustrated in FIGS. 1 through 9, the principal parts of the duplication printer are, as most clearly shown in the plan view of FIG. 3, a frame case 3 of substantially rectangular shape and a movable base 2 having the shape of a rectangular flat plate and adapted to be slidably moved in the longitudinal direction within and relative to the frame case 3. The base 2 has a handle 1.

Throughout the following description the following and related terms are used to indicate portions of the printer. "Left" and "right" respectively correspond to left and right ends as viewed in FIGS. 1, 2 and 3. "Front" and "rear" respectively correspond to the bottom and top edges of the duplication printer as viewed in FIG. 1. "Upper" and "lower" respectively correspond to upper and lower surfaces as viewed in elevational views such as FIG. 2. These respective portions are as viewed by the operator sitting at a desk with the printer on the desk in front of him with the handle 1 on the operator's right-hand side.

As shown in FIG. 3, the frame case 3 has a rectangular opening 3*a* formed therethrough. The elongated front and rear edges 3*b* of the frame case 3 are provided along their inner surfaces with inwardly projecting rib-like rails 4 which are respectively engaged by outwardly opening grooves 2*a* formed along the elongated outer edges of the movable base 2. The movable base 2 is thus guided in longitudinal sliding movement in and out of the frame case 3. The handle 1 provided at the right end of the movable base 2 is to be grasped by the operator for moving the movable base 2 in this sliding movement as described more fully hereinafter.

Figure 5:
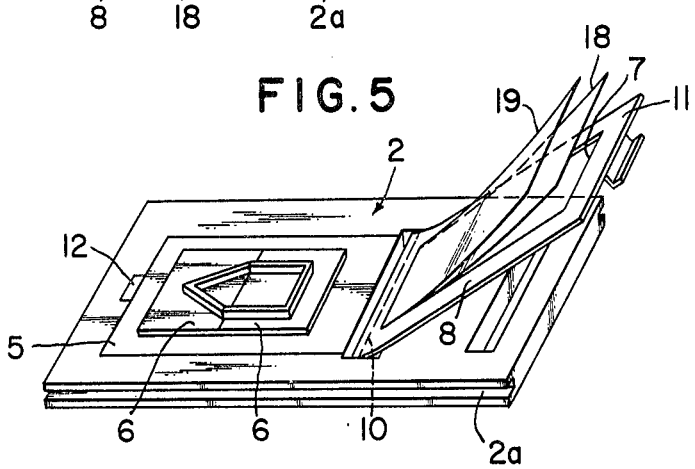
FIG. 5 is a perspective view similar to FIG. 4 showing the movable base with the holding frame, with a displaying sheet and a tacky sheet thereon, in the open state, and a relief plate placed on a cushioning material.
Figure 6:
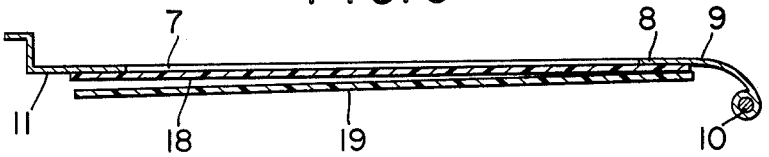
FIG. 6 is a vertical sectional view of the hinged holding frame with the displaying sheet and the tacky sheet thereon.
Figure 7:
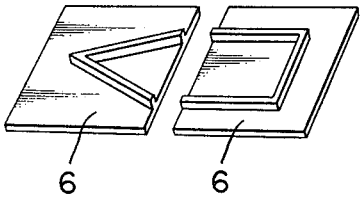
FIG. 7 is a perspective view of a relief plate formed in two parts.

As illustrated in FIGS. 2 and 5, a cushioning material 5 of rectangular shape made of a sheet material such as rubber or an elastic synthetic resin is bonded onto a depressed surface in the upper surface of the movable base 2. A relief plate 6 containing the pattern to be printed is placed on cushioning material 5 at the time of printing as described hereinafter. In the illustrated embodiment, the relief plate 6 is rectangularly shaped and formed by the combination of two halves. The relief plate 6 can be interchanged with various other relief plates with other patterns (not shown).

Above the upper surface of the movable base 2, there is provided a holding frame 8 made of steel, for example, and having a window opening 7 formed therethrough. This holding frame 8 is rotatably hinged at its right end 9 by a hinge pin 10 fixed at its ends to the upper surfaces of the movable base 2. Being made of a magnetic material, the left edge 11 of the holding frame 8 is attracted to the base 2 by a magnet 12 imbedded in the upper surface of the movable base 2 near its left end when the holding frame 8 is swung counterclockwise, a viewed in FIGS. 2 and 6, to its closed state.

A pivot pin 15 is rotatably supported at its two ends on upright flanges 16 positioned on the front and rear edges of the frame case 3 near the right open end thereof. Links 14 are fixed at the upper ends thereof to the pivot pin 15 adjacent the inner surfaces of the flanges 16. The swing links 14, at their lower ends, rotatably support a pressure bar 13 which has a circular cross section and which is parallel to the pivot pin 15.

The bar 13 is preferably made of metal. Thus, the pressure bar 13 can rotate about its longitudinal axis and can also swing about the pivot pin 15 but is prevented from swinging counterclockwise in FIG. 2 past the lowest or free-hanging position by stops 17 respectively fixed to the inner surfaces of the flanges 16. In the lowest position, the pressure bar 13 applies pressure to the cushioning material 5 of the movable base 2 and a pattern duplicating and displaying unit A when the movable base 2 is drawn outwardly from the frame case 3 as described hereinafter. The unit A is a combination of stacked sheets.

Figure 10:
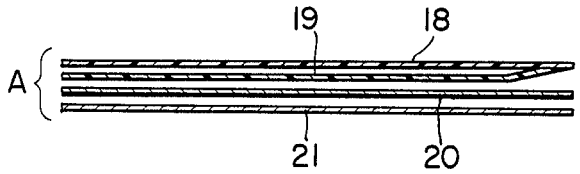
FIGS. 10 through 14 are sectional views respectively indicating the compositions of different examples of the pattern duplicating and displaying unit according to this invention.

In one example of the unit A shown in FIG. 10, the pattern duplicating and displaying unit is a combination of a translucent/opaque sheet 18, a tacky sheet 19, a transfer sheet 20 having an ink layer on one surface thereof, and a sheet of paper 21. In this example, the sheet 18 and the tacky sheet 19 are cut to a size which is somewhat larger than that of the window 7 of the holding frame 8. Then, with the sheet 18 positioned above the tacky sheet 19 with the tacky layer facing the sheet 18, these sheets are positioned with their right end edges fixed to the lower side of the right end 9 of the holding frame 8.

With the movable base 2 fully inserted in the frame case 3 as shown in FIGS. 1 and 2, the relief plate 6 is placed on the cushioning material 5 of the movable base 2. Then the sheet of paper 21 is placed on the relief plate 6 and the transfer sheet 20, with its ink layer on the lower surface, is placed on the paper sheet 21. Further, the tacky sheet 19 and the translucent/opaque sheet 18 are successively stacked on the transfer sheet 20, and the holding frame 8 is closed and its left end 11 is magnetically held by the magnet 12. The pattern duplicating and displaying unit A is thus fixed in place by the holding frame 8.

Figure 8:
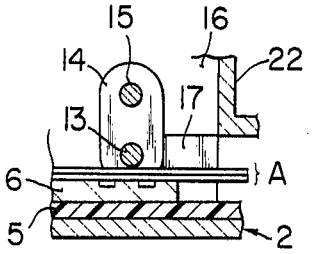
FIG. 8 is a fragmentary vertical sectional view showing a pressure bar applying pressure to a pattern duplicating and displaying unit during duplication printing.

The handle 1 is grasped by an operator's hand, and the movable base 2 is drawn outwardly from the frame case 3, whereupon the pressure bar 13 contacts and starts to apply pressure to the translucent/opaque sheet 18, and the swing links 14 strike against the stops 17 to stop the pivotal movement of the pressing bar 13 as shown in FIG. 8. Then, as the movable base 2 is drawn further outward, the pressure bar 13 traverses the sheet 18 as it presses downward thereon. As the relief plate 6 travels past the pressure bar 13, its pattern is printed on the paper 21 via the ink on the transfer sheet 20 and, simultaneously, is impressed and therefore displayed on the translucent/opaque sheet 18 by the adhesion thereto of parts of the tacky sheet 19 corresponding to the pattern.

When the operator desires to write an inscription on the paper 21, he takes out a stylus 23 held in a bridge member 22 supported on the flanges 16 and writes with this stylus 23 on a desired place on the translucent-/opaque sheet 18. The ink of the ink layer on the transfer sheet 20 is thereby transferred in the inscribed pattern onto the paper 21.

Figure 9:
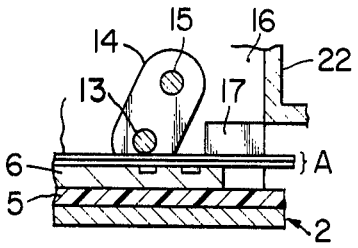
FIG. 9 is a view similar to FIG. 8 showing the pressing bar swung inward and no longer applying pressure to the unit.

Then, when the movable base 2 is pushed inwardly back into the frame case 3, the pressure bar 13 initially contacts the translucent/opaque sheet 18, and the swing links 14 are thus swung in the direction of movement of the movable base 2, or clockwise as viewed in FIG. 9, whereby the pattern duplicating and displaying unit A is freed from the pressure applied thereto by the pressure bar 13. When the movable base 2 has been returned to its original position within the frame case 3, the pattern displayed on the upper most translucent/opaque sheet 18 is carefully examined. After the viewer is satisfied with the displayed pattern, he opens the holding frame 8 and takes out the printed paper 21. The translucent/opaque sheet 18 and the tacky sheet 19 are separated to erase the pattern displayed on the sheet 18.

Figure 17:
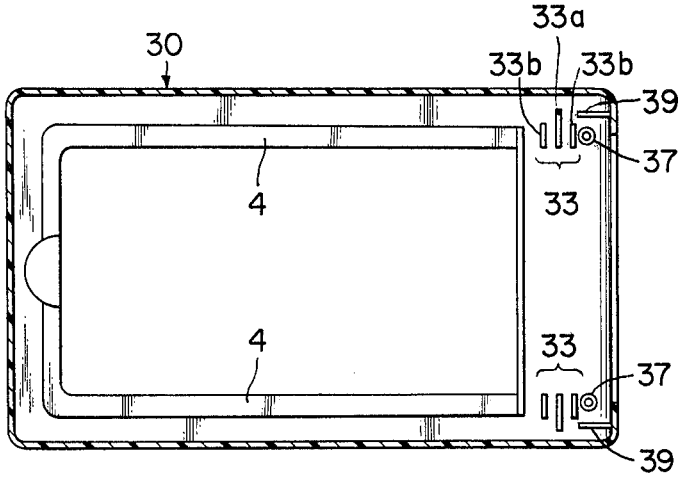
FIG. 17 is a view substantially the same as FIG. 16 but with the pressure bar, swing arms, and pivot rod removed to show the means for supporting the pivot rod.

In the second embodiment of this invention as illustrated in FIGS. 15 through 21, similarly as in the first embodiment, a movable base 2, provided with a sheet cushioning material 5, a holding frame 8, and other parts, is adapted to be drawn out of and pushed back into a frame case 30. This frame case 30 has, at its right end, an integrally formed bridge 31 with a cover 32. As indicated in FIG. 17, on the inner surface of the cover, at each of the front and rear edges thereof, a central projection 33*a* and a pair of ribs 33*b* on opposite sides thereof are formed integrally with the cover 32 to constitute a mounting means 33 for functioning as a bearing and holding part for a pivot rod 34 of circular cross section. The pivot rod 34 is thus rotatably held at each end thereof by two flanking ribs 33*b* and the central projection 33*a* is in contact with the rod 34. The pivot rod 34 is prevented from disengaging from each of the mounting means 33 by retainers 38 which respectively abut the rod and are detachably secured by screws 37*a* to support projections 37 formed integrally on the inner surface of the bridge 31. The retainers 38 are preferably metal plates.

The pivot rod 34, preferably made of synthetic resin, is provided at its ends with integrally formed, parallel swing arms 35 which rotatably support a metal pressure bar 36 at their ends. Thus, the pressure bar 36 can rotate about its longitudinal axis and can also swing about the pivot rod 34 but is prevented from swinging rightward past its lowest, or free-hanging, position by stops 39 formed integrally with the bridge 31 on the inner wall surface thereof. When the pressure bar 36 is thus held in its lowest state by the stops 39, it is capable of applying pressure to the relief plate 6 placed on the cushioning material 5 of the movable base 2 and the pattern duplicating and displaying unit A stacked thereon similarly as in the first embodiment of the invention.

In the second embodiment, a guide bar 41 is supported by the frame case 30 near the lower edge of its right end and which functions to guide the movable base 2 and to check the movement thereof at the end of its outward movement and to prevent the movable base 2 from being pulled completely out of the frame case 30.

In the operation of this second form of the duplication printer of this invention, with the movable base 2 fully inserted in the frame case 30, the relief plate 6 is placed on the cushioning material 5 of the movable base 2, and then, as in the first embodiment of the invention, the paper, transfer sheet, tacky sheet, and translucent-/opaque sheet are successively stacked.

Figure 18:
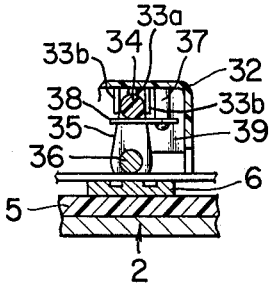
FIG. 18 is a fragmentary vertical sectional view of the second embodiment showing the pressure bar of the printer applying pressure to a pattern duplicating and displaying unit during printing.
Figure 20:
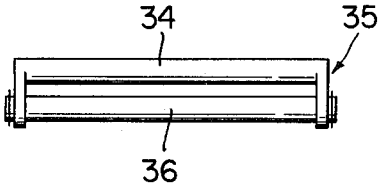
FIGS. 20 and 21 are side and end elevational views of the pressure bar, swing arms, and pivot rod of the frame case shown in FIGS. 15 through 19.
Figure 21:
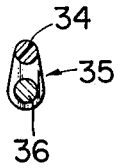

Then, as the movable base 2 is drawn outwardly from the frame case 30, the pressure bar 36 contacts the upper surface of the translucent/opaque sheet and starts to apply pressure thereto. At this instant, the swing arms 35 strike against and are stopped by the stops 39 as shown in FIG. 18. As the relief plate 6 is moved past the pressure bar 36 in this state, the pattern of the relief plate 6 is printed, via the link on the transfer sheet, onto the paper sheet and, simultaneously, is displayed on the translucent/opaque sheet through the adhesion of parts of the tacky sheet to the translucent/opaque sheet.

Figure 19:
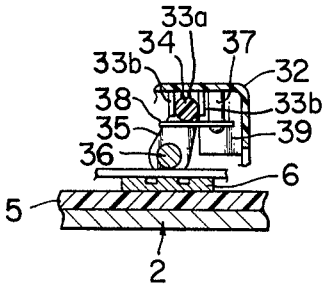
FIG. 19 is a view similar to FIG. 18 showing the pressure bar swung inward and no longer applying pressure to the unit.

Similarly to the first embodiment of the invention, when the movable base 2 is pushed back into the frame case 30, the pressure bar 36 is moved in the direction of return movement of the movable base 2, swinging clockwise as viewed in FIG. 19, and no longer applies pressure to the pattern duplicating and displaying unit A. After the movable base 2 has been fully returned to its original position, the duplication printed paper is taken out, and the translucent/opaque and tacky sheets are separated, whereupon the displayed pattern is erased.

The composition of the pattern duplicating and displaying unit is not limited to that of the unit A but may take other forms such as, for example, those of units Aa and Ab described below, with which duplication printing and displaying of relief patterns can be carried out equally well with the unit A.

Figure 11:
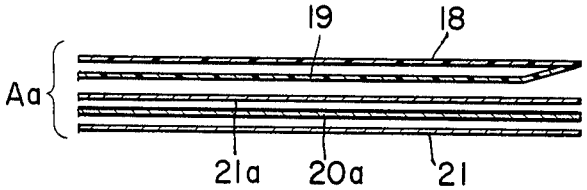

As indicated in FIG. 11, the pattern duplicating and displaying unit Aa comprises, in order from top to bottom, a translucent/opaque sheet 18, a tacky sheet 19, a paper sheet 21*a*, a double transfer sheet 20*a* with ink layers on both of its outer surfaces, and paper sheet 21. The sheet 18 and the tacky sheet 19 are substantially the same as those of the unit A and are secured along their right ends to the lower surface of the holding frame 8 near the right end of its window opening 7. At the time of duplication printing, a relief plate 6 is placed on the cushioning material 5 of the movable base 2, and then, successively, the paper sheet 21, the double transfer sheet 20*a*, the paper sheet 21*a*, the tacky sheet 19, and the translucent/opaque sheet 18 are stacked thereon. Then, by pulling the movable base 2 outwardly as described hereinbefore, duplication printing and displaying of the pattern of the relief plate 6 can be accomplished.

Figure 12:
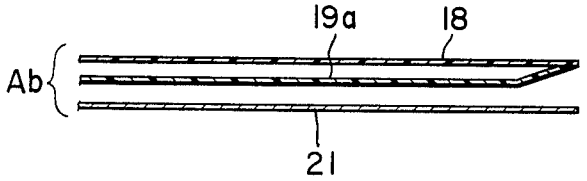

The pattern duplicating and displaying unit Ab, as indicated in FIG. 12, comprises, in order from top to bottom, a translucent/opaque sheet 18, a tacky transfer sheet 19*a* having a tacky layer on one (upper) surface thereof and an ink layer on the other (lower) surface thereof, and a paper sheet 21. The sheet 18 and the tacky transfer sheet 19*a* are secured at their right ends to the lower surface of the holding frame 8 similarly to the case of the sheet 18 and the tacky sheet 19 of the unit A. At the time of duplication printing, the paper sheet 21, the tacky transfer sheet 19*a*, and the sheet 18 are successively stacked on the relief plate 6, and the movable base 2 is pulled outwardly, as described hereinbefore, to carry out duplication printing and displaying.

Figure 13:
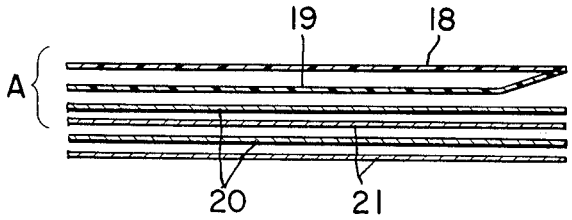

Furthermore, as indicated in FIG. 13, the pattern duplicating and displaying unit A can be stacked above a combination of a paper sheet 21 placed on the relief plate 6 and a transfer sheet 20 with an ink layer on its lower surface facing the upper surface of the paper sheet 21. Then, by the same duplication printing procedure as described hereinbefore, the pattern of the relief plate 6 can be duplication printed simultaneously on two paper sheets 20.

Figure 14:
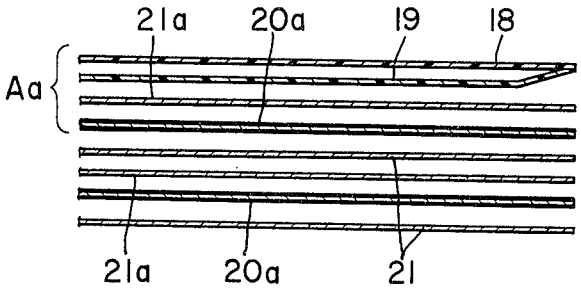
Figure 15:
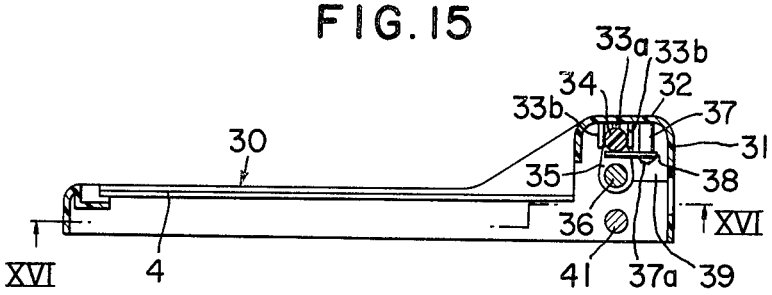
FIG. 15 is sectional elevational view of the frame case of a second embodiment according to the invention.
Figure 16:
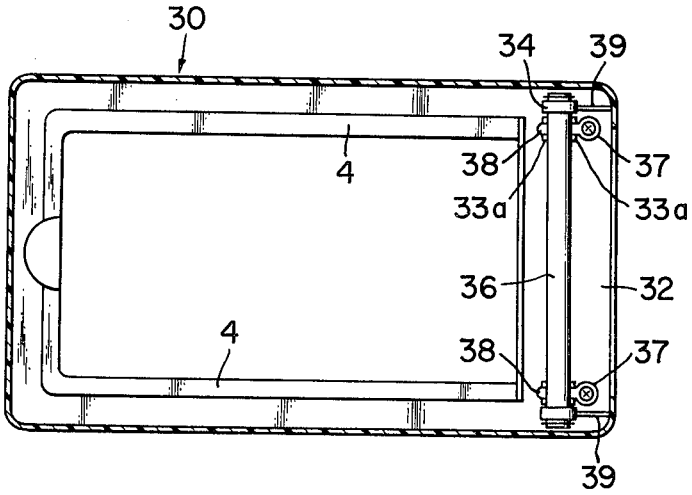
FIG. 16 is a view taken along the line XVI—XVI in FIG. 15.

In addition, as indicated in FIG. 14, the pattern duplicating and displaying unit Aa can be stacked above a combination of a paper sheet 21 placed on the relief plate 6, a double transfer sheet 20*a* having ink layers on both of its surfaces which is placed on this paper sheet 21, and a paper sheet 21*a* placed on this double transfer sheet 20*a*. Then, by the same duplication printing procedure as described hereinbefore, the pattern of the relief plate 6 can be duplication printed simultaneously on two paper sheets 21*a* and can be duplication printed simultaneously on the two other paper sheets 21, the printed image thereon being a reverse or mirror image of the patterns of the relief plate 6.

The translucent/opaque display sheet used in this invention is made of a material selected from, but not necessarily limited to, either of the following two classes of materials:

(a) Semirigid or rigid plastic such as polyester resins, polyolefin resins, vinyl resins, and cellulose resins in sheet form and having a frosted finish on one surface which faces the tacky layer of the tacky sheet or the tacky transfer sheet or having a frosted finish on both surfaces. The thickness of the sheet is, for example, 20 to 100 microns.

(b) Semirigid or rigid plastic in sheet form with surfaces covered with fine powder of white or light colored material such as titanium oxide. The thickness of the sheet is, for example, 20 to 100 microns.

The tacky sheet comprises a transparent or dark colored plastic sheet or paper and an adhesive or tacky layer applied on one surface thereof. The tacky layer is of a character such that it adheres intimately, but is such that it adheres to but is separable from the translucent-/opaque display sheet. For the tacky adhesive, any of the following adhesive materials can be used;

(a) Animal and vegetable waxes, mineral waxes, synthetic waxes, and mixtures of these waxes.

(b) Resins having an adhesive character at room temperature such as, for example, ester gum, ethylenevinyl acetate copolymers, ethylene-acrylic ester copolymers, and rosin-modified alkyd resins.

(c) Mixtures of waxes of (a) and resins of (b).

(d) Pressure-sensitive adhesives. The color of this tacky adhesive can be suitably selected from adhesives having no color to those having a dark color.

The transfer sheet comprises a paper or plastic sheet and a layer of ink applied to one surface or both surfaces thereof. Examples of suitable inks are as follows;

(a) Inks comprising substances selected from resins such as vinyl resins and acrylic resins, non-volatile liquids such as mineral oils, animal and vegetable oils, surfactants, and fatty acid esters, paste materials such as vaseline, and coloring agents (pigments and dyes).

(b) Inks comprising substances selected from waxes such as animal and vegetable waxes, mineral waxes, and synthetic waxes, coloring agents (pigments and dyes), and liquid components such as mineral oils, animal and vegetable oils, and fatty acids.

Examples of suitable transfer sheets are transfer paper such as, for example, plastic carbon paper 100B for single surface copy, carbon paper CPTE #30 (carbon paper manufactured by Pilot Man-Nen-Hitsu K.K.), and plastic carbon film PCF-TE-T3B (carbon film manufactured by Pilot Man-Nen-Hitsu K.K.).

For the cushioning material of the movable base, a porous or foamed sheet of a material such as rubber, vinyl chloride resin, polyethylene, or polyurethane is used.

For the relief plate, materials such as plastic, metal, wood, or rubber can be used. Relief patterns such as characters, diagrams, designs, and graphical figures are formed in relief on this relief plate by a method such as injection molding, etching, machining, press molding, or casting. Certain desired patterns can be formed on a single relief plate, while others can be formed by combining a plurality of relief plates. While higher relief projections produce better results, optimum heights are 0.3 mm or more.

The holding frame for holding the pattern duplicating and displaying unit during printing can be fixed in the closed state by any of various means which will not interfere with the operation of the duplication printer. In one example, the holding frame is pivotally supported along its one end by a hinge on the movable base and has, at least at its opposite free end, an iron member fixed thereto or imbedded therein. Alternatively, the free end may be made entirely of iron, and a magnet may be fixed to or imbedded in the movable base to attract the iron member or the holding frame when the holding frame is closed to thereby firmly secure the holding frame in the closed state.

As will be understood from the foregoing description, the duplication printer of this invention has a simple construction and operation and therefore has many uses and a wide range of applications. For example, such uses may be as a toy or as an educational means. Furthermore, the printer can be advantageously used for printing various cards, notes, and announcements such as greeting cards, invitation cards, notices, form slips, and picture cards.

What is claimed is:

1. A duplication printing device comprising:

a movable base having a cushioning material on an upper surface thereof and a holding frame, said holding frame having a window opening therethrough and being removably superimposed over the upper surface of said movable base;

a relief plate having an image thereon and being removably positioned over said cushioning material;

an image duplicating and displaying unit being removably positioned over said relief plate, said unit having a paper sheet for printing said image thereon, an ink layer means for relief printing said image on said paper sheet, a display sheet, and a tacky sheet positioned adjacent said display sheet for, when said image is printed on said paper sheet, adhering to said display sheet at parts of said display sheet positioned over the parts of said image, said unit being held in position by said frame for relief printing and for visually displaying said display sheet through said window opening;

a frame case having a bridge portion upwardly extending from a top surface thereof, said bridge portion having an inner surface spaced from and facing the top surface of said frame case said frame case having an aperture defined by said bridge portion inner surface and the top surface of said frame case;

said movable base slidably extending through said aperture and slidable toward and away from said frame case;

a rotatable pivot rod extending across said aperture;

a mounting means for rotatably mounting the ends of said pivot rod on said bridge portion, said mounting means including two sets of ribs one at each opposite end of said pivot rod, and two retainers, one associated with each set of ribs, each set of ribs being integrally formed with the inner surface of said bridge portion and being spaced apart from one another, the ribs of each set extending from said inner surface and being spaced apart and rotatably accommodating said pivot rod therebetween, each of said retainers being connected to said bridge portion and respectively extending transversely across the space between the ribs of each set, said pivot rod being rotatably accommodated between each of said retainers and said inner surface;

said pivot rod respectively having swing links thereon and extending downwardly therefrom toward said frame case, the free ends of said links being movable around the longitudinal axis of said pivot rod between a first position and a second position;

said frame case having at least one stop operatively associated with said swing links for, when said free ends are pivoted to said first position, abutting said swing links for preventing said swing links from pivoting further in one direction; and a pressure bar connected to said free ends of said swing links for, when said movable base is slid away from said frame case, frictionally engaging a top surface of said unit for pivoting said swing links to said first position and for causing said bar to press firmly against and slide over the top surface of said unit, whereby said image is relief printed on said paper sheet, and for, when said movable base is slid toward said frame case, frictionally engaging a top surface of said unit for pivoting said swing links to said second position for causing said bar to cease pressing firmly against the top surface of said unit.

2. A duplication printing device as claimed in claim 1, wherein said mounting means further comprises two support projections, each of said projections extending from said inner surface and connecting one of said retainers to said inner surface; and said retainers are elongated plates.

3. A duplication printing device as claimed in claim 1 or 2, wherein said mounting means further comprises two central projections, each connected to said inner surface and respectively positioned between the ribs of each set; and said pivot rod is rotatably accommodated between each of said retainers and corresponding central projections.

4. A duplication printing device as claimed in claim 1 or 2, wherein said swing links are made of a synthetic resin and said pressure bar is made of metal.

5. A duplication printing device as claimed in claim 1 or 2 wherein:

said ink layer means is a transfer sheet which has an ink surface on one side thereof;

said tacky sheet has a tacky surface on one side thereof;

said paper sheet is immediately atop said relief plate, said transfer sheet is immediately atop said paper sheet and said ink surface is downwardly facing, said tacky sheet is immediately atop said transfer sheet and said tacky surface is upwardly facing, said display sheet is atop said tacky sheet; and said display sheet is translucent.

6. A duplication printing device as claimed in claim 1 or 2 wherein:

said tacky sheet surface on one side thereof;

said unit has a second paper sheet;

said ink layer is a transfer sheet which has an ink surface on both sides thereof;

the first-mentioned paper sheet is immediately atop said relief sheet, said transfer sheet is immediately atop said first mentioned paper sheet, said second paper sheet is immediately atop said transfer sheet, said tacky sheet is immediately atop said transfer sheet and said tacky surface is upwardly facing, said display sheet is atop said tacky surface; and said display sheet is translucent.

7. A duplication printing device as claimed in claim 1 or 2 wherein:

said tacky sheet has a tacky surface on one side thereof and said ink layer means is on the second side thereof;

said paper sheet is immediately atop said relief sheet, said tacky sheet is immediately atop said paper sheet and said second side is downwardly facing, said display sheet is atop said tacky sheet side; and said display sheet is translucent.

8. A duplicating printing device as claimed in claim 1 or 2, in which said holding frame has first and second ends and further comprising:

a hinge means pivotally connecting the front end of said holding frame to said movable base;

a magnetic member attached to the second end of said holding frame; and a magnet means attached to said movable base for, when said holding frame is superimposed over said movable base, magnetically attaching said holding frame to said movable base.

* * * * *